US005308268A

United States Patent [19]

Schmid

[11] Patent Number: 5,308,268

[45] Date of Patent: May 3, 1994

[54] HUMANLY OPERABLE, RECREATIONAL, READILY DISASSEMBLABLE WATER CYCLE

[75] Inventor: August Schmid, Schwerzenbach, Switzerland

[73] Assignee: A. G. Schmid AG, Schwerzenbach, Switzerland

[21] Appl. No.: 963,114

[22] Filed: Oct. 19, 1992

[51] Int. Cl.[5] ..... B63H 21/175

[52] U.S. Cl. ..... 440/30; 114/61; 114/362; 440/21

[58] Field of Search ..... 114/61, 144 R, 343, 114/362, 270; 440/21, 26–30

[56] References Cited

U.S. PATENT DOCUMENTS

| | | | |
|---|---|---|---|
| 1,920,391 | 8/1933 | Herwig | 440/30 |
| 2,674,971 | 4/1954 | Therrien | 440/30 |
| 3,336,004 | 8/1967 | Edie et al. | 114/270 |
| 4,077,351 | 3/1978 | Girona . | |
| 4,664,051 | 5/1987 | Newkirk | 114/270 |
| 4,813,514 | 3/1989 | Lathers | 114/362 |
| 5,011,441 | 4/1991 | Foley et al. | 440/30 |

FOREIGN PATENT DOCUMENTS

| | | |
|---|---|---|
| 863312 | 1/1953 | Fed. Rep. of Germany . |
| 1335307 | 7/1963 | France . |
| 2139599 | 1/1973 | France . |
| 2513134 | 12/1983 | France . |
| 2557848 | 7/1985 | France . |
| 1459075 | 12/1976 | United Kingdom . |

*Primary Examiner*—David M. Mitchell
*Assistant Examiner*—Stephen P. Avila
*Attorney, Agent, or Firm*—Frishauf, Holtz, Goodman & Woodward

[57] ABSTRACT

To permit rapid assembly and disassembly of the water cycle so that, when disassembled, it can be stored or transported in minimum space. The cycle, which has at least three flotation bodies (2*a*, 2*b*, 2*c*), which are elongated or torpedo shaped, is formed of tubular frame elements which are coupled together by push-in connectors with spring-loaded pin locks (9, 30, 30', 33, 41) so that individual frame elements (6,7,8; 12,13,14; 24,25) of the cycle can be disassembled into the frame elements, or, selectively, snapped together. The flotation bodies are preferably inflatable and formed with a keel. A pedal and crank arrangement is coupled to a transmission which can drive a propeller or, directly via a chain, a paddle wheel. To prevent damage to the propeller if it meets an obstruction, a propeller attachment and a housing therefor is releasably mounted on a frame for pivoting movement upwardly and downwardly, with various positions of the propellers selectable by a spring loaded engagement hook engaging in recesses in a positioning disk; and, to permit lateral deflection, the housing is rotatable about an axis transverse to the direction of movement (A) of the cycle, and positioned in predetermined location by a spring-loaded claw clutch to permit release, in the lateral direction, if an obstruction is encountered.

20 Claims, 10 Drawing Sheets

HUMANLY OPERABLE, RECREATIONAL, READILY DISASSEMBLABLE WATER CYCLE

THE FIELD OF THE INVENTION

The present invention relates to a recreational water cycle, or water velo, and more particularly to a water cycle which can be easily assembled and disassembled and which, when disassembled can be stored or transported in minimum space; for assembly, only a few steps, which can be carried out rapidly and without tools are required.

BACKGROUND

Various types of water cycles are known which have bicycle-type pedals to move the water cycle, together with occupants, over a water surface. These water cycles are relatively heavy, cannot be folded, and take up substantial storage space. They cannot be readily transported in the trunk of a passenger car.

It has previously been proposed—See U.S. Pat. No. 4,077,351, Girona, to provide a water cycle which has three flotation elements in the form of tires; the flotation elements are located in a triangular configuration, with two transversely aligned rear elements and one front element, which, similar to a front wheel of a bicycle, can be steered. To move this structure, paddles are secured to the rear tires, and coupled to bicycle-type pedals by a chain drive.

THE INVENTION

It is an object to provide a water cycle which is light-weight, stable, and which, when not in use, can be easily disassembled and, when disassembled, takes up only minimum space, to permit storage in a small area, shipment in small cartons, while still being sturdy and readily assembled, when use is intended, in minimum time and without tools.

Briefly, the water cycle has three flotation bodies, which are elongated. A frame is coupled to the rotation bodies by quick release coupling elements; the frame itself is built of a plurality of frame elements which preferably form triangular frame portions, which, in turn, are connected by quick release couplings. Preferably, the frame elements are joined together at coupling sleeves or bushings and locked in position by spring-loaded locking pins. The frame, itself, is preferably made of tubular material, for example noncorrosive light-weight metal. Preferably, the flotation bodies are made of inflatable plastic material, so that, when disassembled from the frame, they can be collapsed and the entire cycle will take up only minimum space. The flotation bodies which are elongated can, in accordance with the feature of the invention, be of generally circular cross-sectional shape to provide essentially torpedo-like configuration, provided, preferably, with a performed keel.

A water cycle in accordance with the invention has the advantage that it can be readily assembled and disassembled for transportation and storage and minimum space without tools.

In accordance with the feature of the invention, elements of a propeller which dip into the water can be protected against damage by providing overload couplings or clutches, so arranged that one overload device responds to obstructions against which the cycle may run up, that is, in the direction of movement on the cycle; another overload device can respond to transverse overloads or obstructions.

DRAWINGS

DETAILED DESCRIPTION

Figure 1:
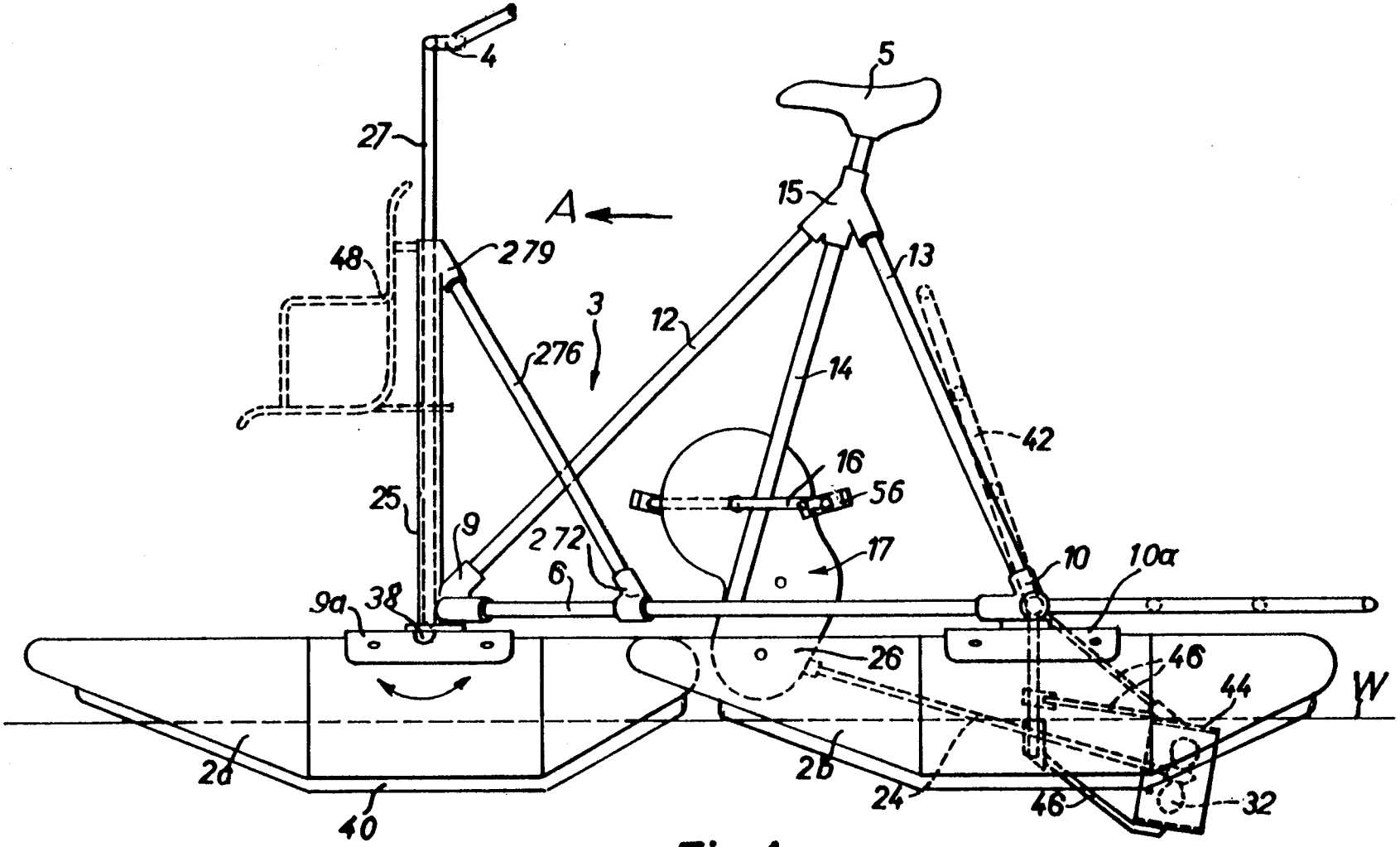
FIG. 1 is a highly schematic side-view of the cycle.
Figure 2:
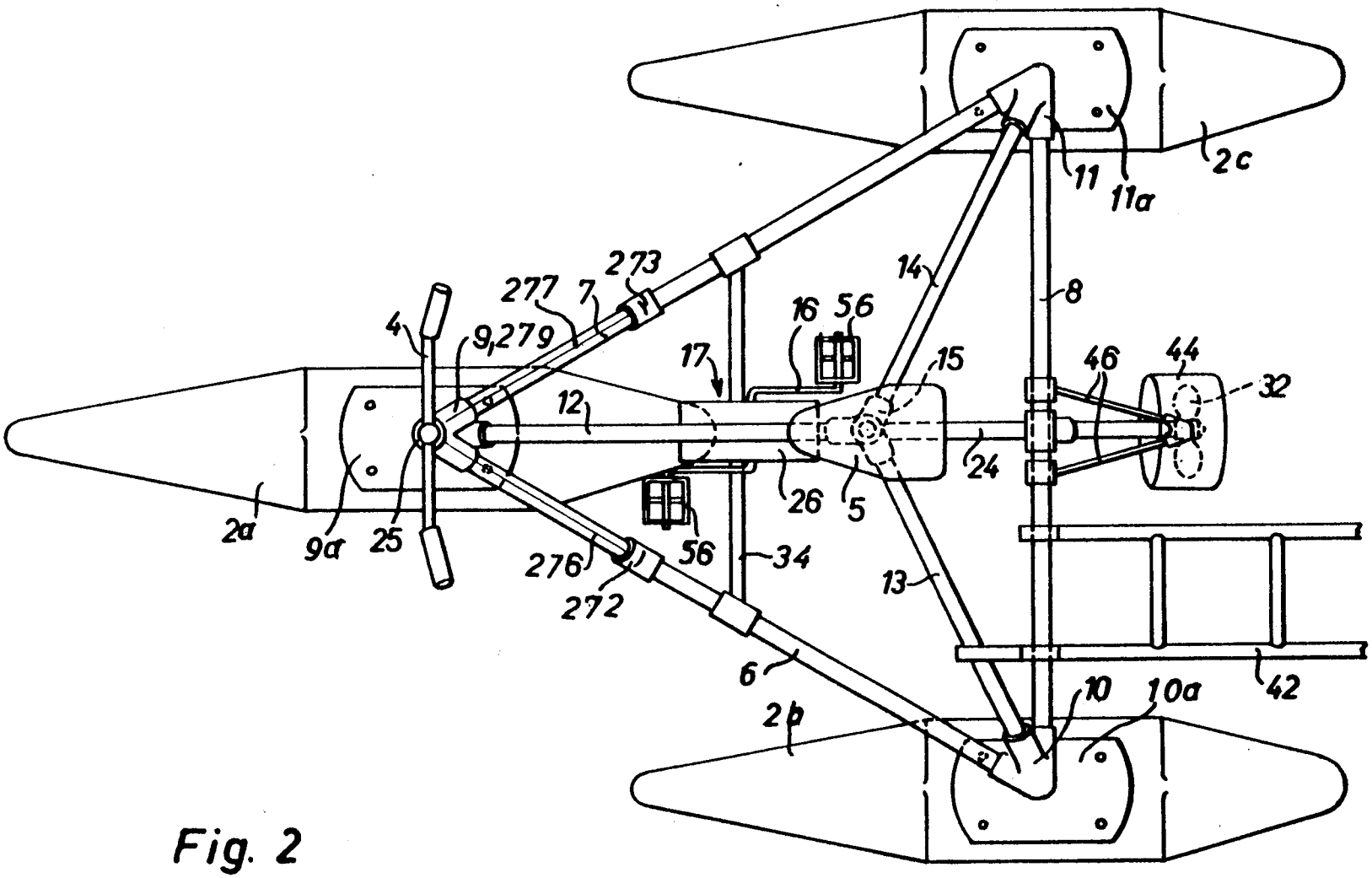
FIG. 2 is a top-view of the cycle.
Figure 3:
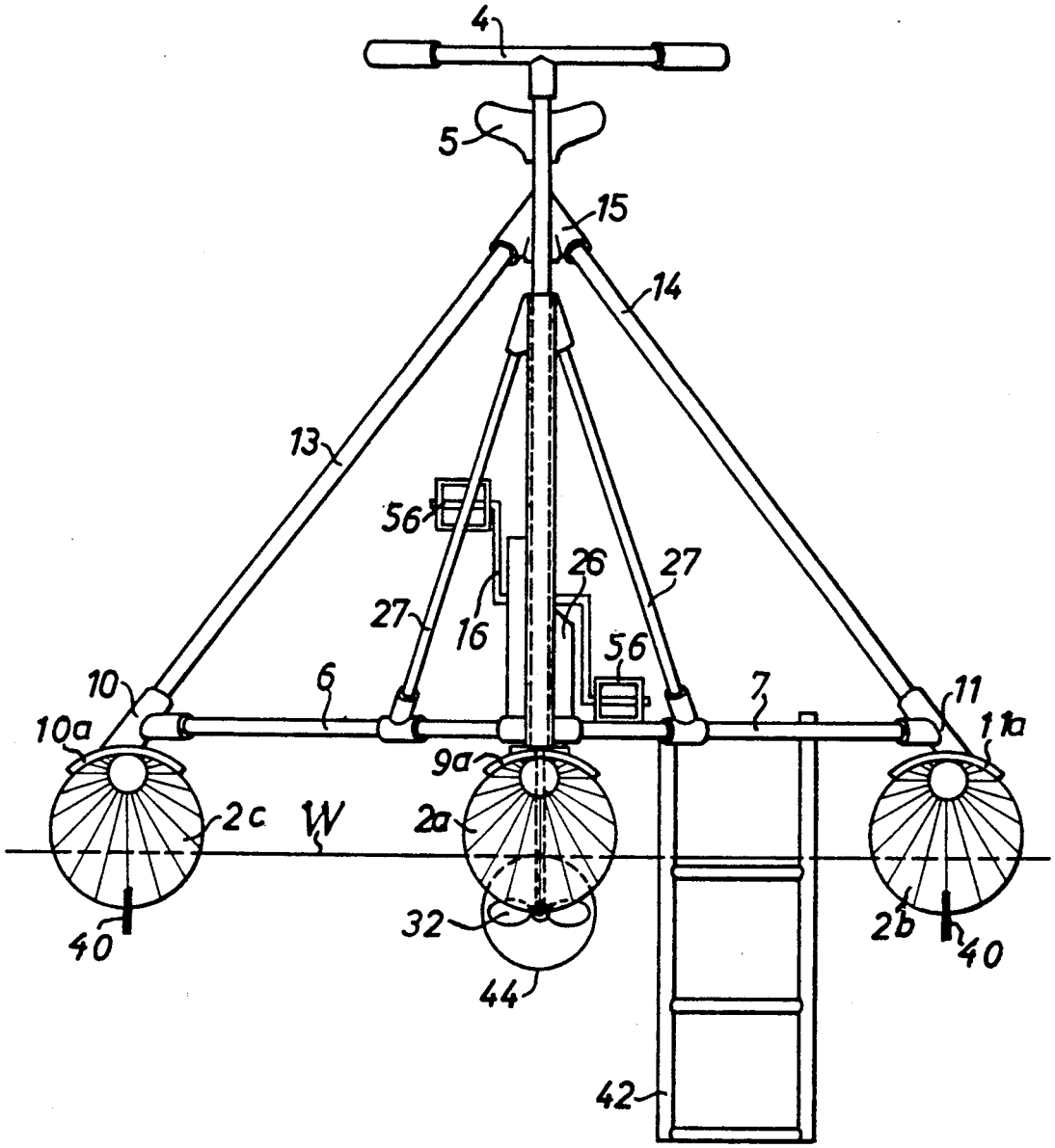
FIG. 3 is a rear-view of the cycle.

Referring first to FIG. 1-3: The cycle has a frame 3 and three flotation elements 2*a*, 2*b*, 2*c*. The frame is made of tubular material, and the tubes of the frame are interconnected by coupling sleeves. A handlebar 4 is provided to steer the cycle, coupled to the forward flotation body 2*a*. A saddle 5, for example a standard bicycle saddle is provided as a seat for the user.

The frame, in top-view, is essentially triangular, and constructed of essentially rectangular frame portions. As best seen in FIG. 2, the frame has a first essentially triangular frame portion formed by the tubular elements 6, 7, 8 which, when assembled and in use, is in an essentially horizontal plane. The tubes or pipes 6, 7, 8 are releasable inserted or fitted in chiing sleeves or bushings 9, 10, 11. The frame further includes a second, and upwardly extending frame section having three tubes 12, 13, 14 (see FIG. 1). A saddle connector 15 receives the upper ends of the tubes 12, 13, 14, which extend in form of a tripod downwardly to the first frame portion formed by the tubes 6, 7, 8. The three legs 13, 14, 15 of the second frame section include, with respect to each other, an angle of about 120°, when looked at from above. The ends of the tubes 12, 13, 14, are likewise, releasably received in the coupling sleeves 9, 10 and/or 11. A tube 25 extends vertically from coupling 9; it can be somewhat inclined toward the seat 5. A handlebar post 27 extends into the tube 25. A joint 38, having a horizontal axis of freedom extending transversely to a longitudinal plane passing through the saddle and the center of the handlebar 4 permits limited pivoting movement of the forward flotation body 2*a* so that it can ride over or pivot about small waves. In addition, and to provide further stiffness, one or two bracing rods or tubes 276 and 277 (FIG. 1) can e coupled by couplings 272, 273 to both tubes 6, 7, or possibly to only one of the tubes 6, 7 of the first frame portion, for example the tubes 6 and 7. Tubes 276 and 277, in top view (FIG. 2) are congruent with tubes 6 and 7, and have been shown in FIG. 2 only schematically by single lines. The tubes, and the sleeves and coupling elements, that is, coupling sleeves and bushings and the reception couplings are preferably made of lightweight metal.

The frame elements, see especially FIGS. 1 and 2, all form essentially triangular frame portions. These essentially triangular frame portions may have common frame elements. Thus, a first frame portion is formed by elements 6, 7, 8, connected together by couplings 9, 10, 11. A firs further frame portion is formed by elements 6, 12, 13, connected together by couplings 9, 10, 15. A second further frame portion is formed by elements 7, 12, 14, connected together by couplings 9, 11, 15; a third further frame portion is formed by elements 8, 13, 14, connected together by couplings 9, 11 and 15. Two additional frame portions are formed, again essentially in triangular shape, by tube 25, bracing tubes 276, 277, and parts of tubes 6, 7 between coupling 9 and couplings 272, 273. The first, second and third further triangular frame portions are inclined with respect to the horizontal plane, when he cycle is erected and floating, as clearly seen in FIG. 2. The couplings are three-tube connectors, that is, of the tripod type—see FIGS. 1 and 2. Two of the coupling stubs, see FIG. 9, can extend in one common plane, and a third coupling stub at an angle with respect to that common plane. The couplings 9, 10, 11 and joint 38 are secured to the respective flotation bodies by customary attachment flaps 9*a*, 10*a*, 11*a*, to which the couplings can be molded or otherwise secured. When assembled and with a user, the cycle dips into water, shown by the water line W.

An operator crank 16 having pedals 56, similar to bicycle pedals, is located below the saddle 5. It is coupled to a transmission 17. The transmission 17 is located in a closed housing 26.

Figure 5:
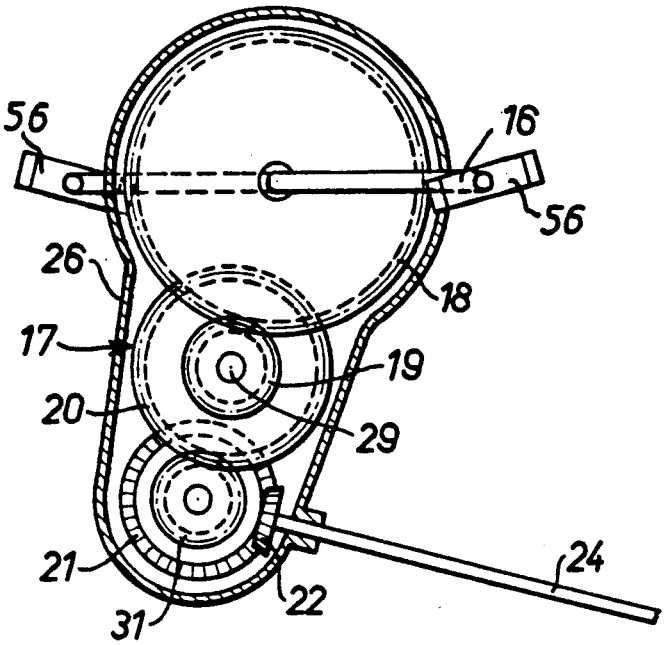
FIG. 5 is a detailed view, partly in section illustrating a first embodiment of a pedal crank drive and gearing.

Referring to FIG. 5: The transmission 17 includes a large gear 18, the shaft of which is coupled to the crank arms 16. The large gear 18 is in engagement with a small gear 19. The shaft of the gear 19 is coupled to a further gear 20 which drives a gear 31, coupled to a bevel wheel gear 21 which, in turn, is coupled to a bevel gear 22 which drive the propeller shaft 24. The propeller shaft extends as an inclination, downwardly, and at its remote end carries a propeller 32. The transmission ratio between rotation of the crank 16 and rotation of the propeller shaft 24 is preferably so selected that at one full revolution of the crank 16, per second, the propeller will receive a rotary speed of approximately 1,350 rpm which is a ratio of about 1:23.5. The propeller is surrounded by a propeller protecting shroud 44, in shape of a drum, and coupled to the horizontal tube 8 of the first frame portion by suitable support rods, or support tubes 46 (see FIGS. 1 and 2).

The flotation bodies 2*a*, 2*b*, 2*c* are preferably identical, and constructed of plastic foil, or sheet material, so that they can be folded, and, for use, blown up to receive approximately the shape shown in FIGS. 2 and 3, in top and end view, respectively. Preferably, the plastic is so molded and constructed that a keel 40 will result. The flotation bodies have, generally, elongated torpedo shape, for example of essentially circular, or oval cross-section with the keel 40 integrally molded therein. In the central region—with respect to the longitudinal extent of the respective flotation bodies—they are preferably essentially circular, or otherwise rounded. The diameter of any flotation body preferably decreases towards the leading or forward end of the cycle.

In accordance with a feature of the invention and to permit ready assembly and disassembly, without tools, the tubes and connecting sleeves or bushings are so constructed that they form push-in and snap-in connections.

Figure 6:
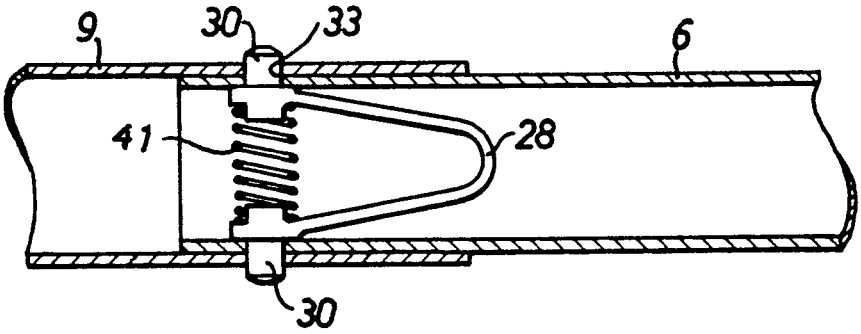
FIG. 6 is a fragmentary sectional view illustrating a rapid release coupling arrangement between a frame portion and a flotation element or, another frame portion, respectively.

Referring now to FIG. 6, which shows one of any one of the connections, in schematic form: The outer sleeve or bushing 9 is formed with diametrically opposite through-bores 33. The tubes have pins 30, 30' coaxially located therein, pressed toward the outside by a spring 41, and coupled together by a connecting bail, or connecting strap 28. The pin 30 fits into the aligned through-bores 33 in the sleeve 9. The spring 41 is so dimensioned that the pins 30, which are preferably rounded at the outer end, can be compressed by hand, permitting the tube 6 to be released from the sleeve 9. This permits easy connection and disassembly of the tubes from the respective sleeve or sleeves, or bushings, or portions of connecting joints, without tools. The space of requirement of the cycle then, when in disassembled condition, is small. The flotation bodies 2*a*, 2*b*, 2*c* when deflated can be folded, to take up only little space. Suitable valves, such as bicycle valves or the like, can be secured to the flotation bodies; they have been omitted from the drawings for simplicity. overall, thus, the cycle can be stored, and transported in minimum space, and can be assembled, where desired, rapidly and without tools.

Figure 4:
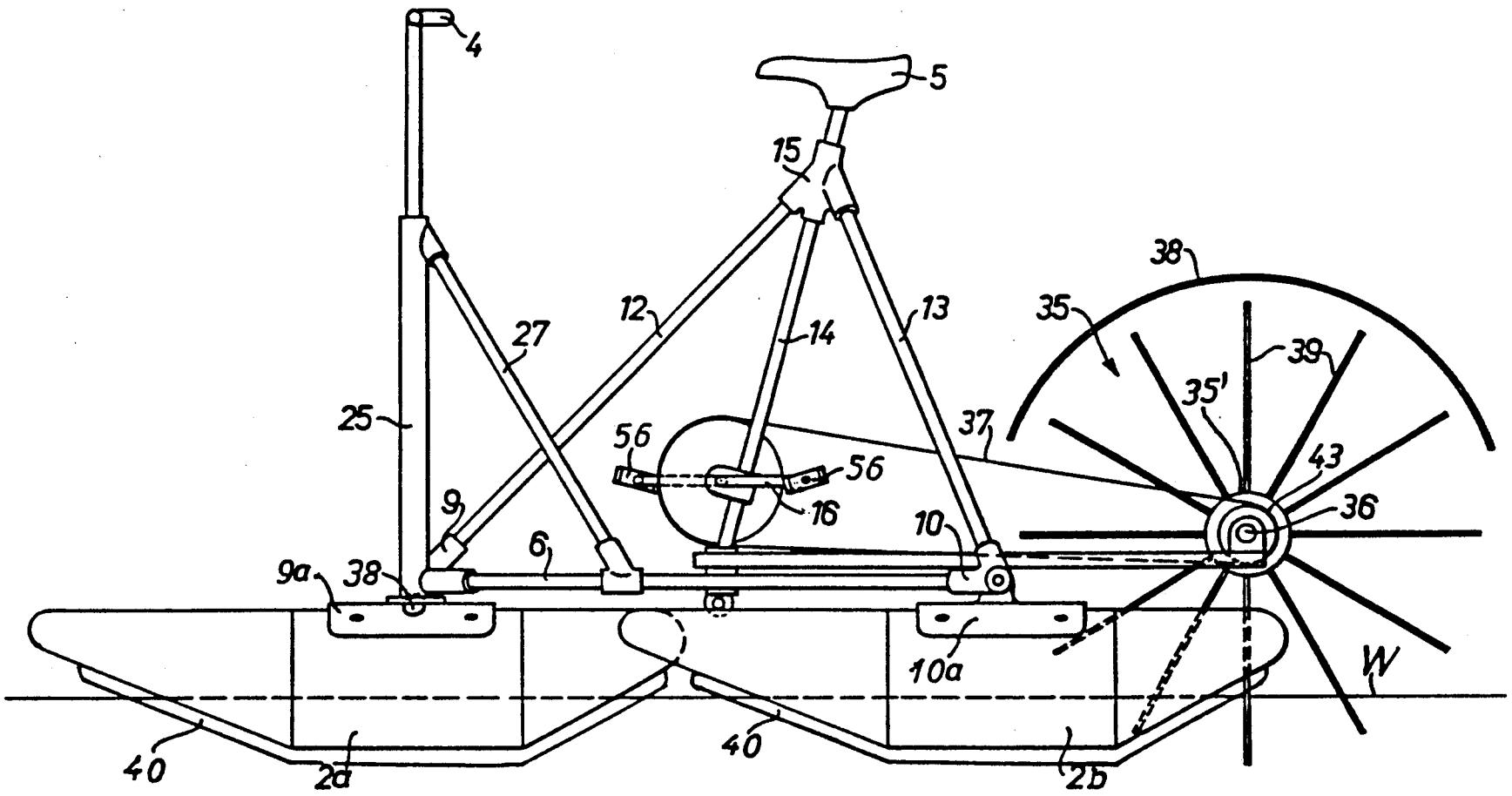
FIG. 4 is a side-view of the cycle, similar to FIG. 1 and illustrates another embodiment.

In accordance with another embodiment of the invention, the propulsion of the cycle can be obtained, not by a propeller, but rather by a paddle wheel; referring to FIG. 4, which shows a paddle wheel: Preferably, two paddle wheel units 35 are provided, secured to a common shaft 36. A sprocket wheel 43 is located between the paddle wheel units 35, in engagement with a chain 37 which, in turn, is coupled to a hub 36 of the crank 16. The individual paddles 39, preferably, can be removed from and inserted into the paddle wheel hub 35' to permit easy assembly and disassembly, and, again, decreasing the space requirement of the cycle, when disassembled. The paddle wheel 35 is so located that only the lower ends of the paddles are below water. A splash guard 45, suitably secured, similar to bicycle mud guards, for example, is provided to prevent splashing of water picked up by the paddles.

The size of the flotation bodies 2*a*, 2*b*, 2*c* will be determined, to some extent, by the intended use, that is, whether the cycle is to be used by adults or children. When using oversized flotation bodies, the cycle can readily be constructed in tandem, with two saddles located next to each other.

A child's seat 48 can be located at the support tube 25 for the handlebar 4, see FIG. 1. This, for example, can be an accessory item separately supplied for the cycle. The seat, if desired, can be rotatable about the forward handlebar tube 25. If desired, a ladder 42 can be coupled to the rear crosstube 8, see FIG. 3, preferably rotatable about tube 8. Upon disassembly of the tube 8 from the frame, the tube can be slit out of the connection sleeves for the ladder 42, thus again reducing the overall space requirement and permitting flat storage and shipment.

Figure 7:
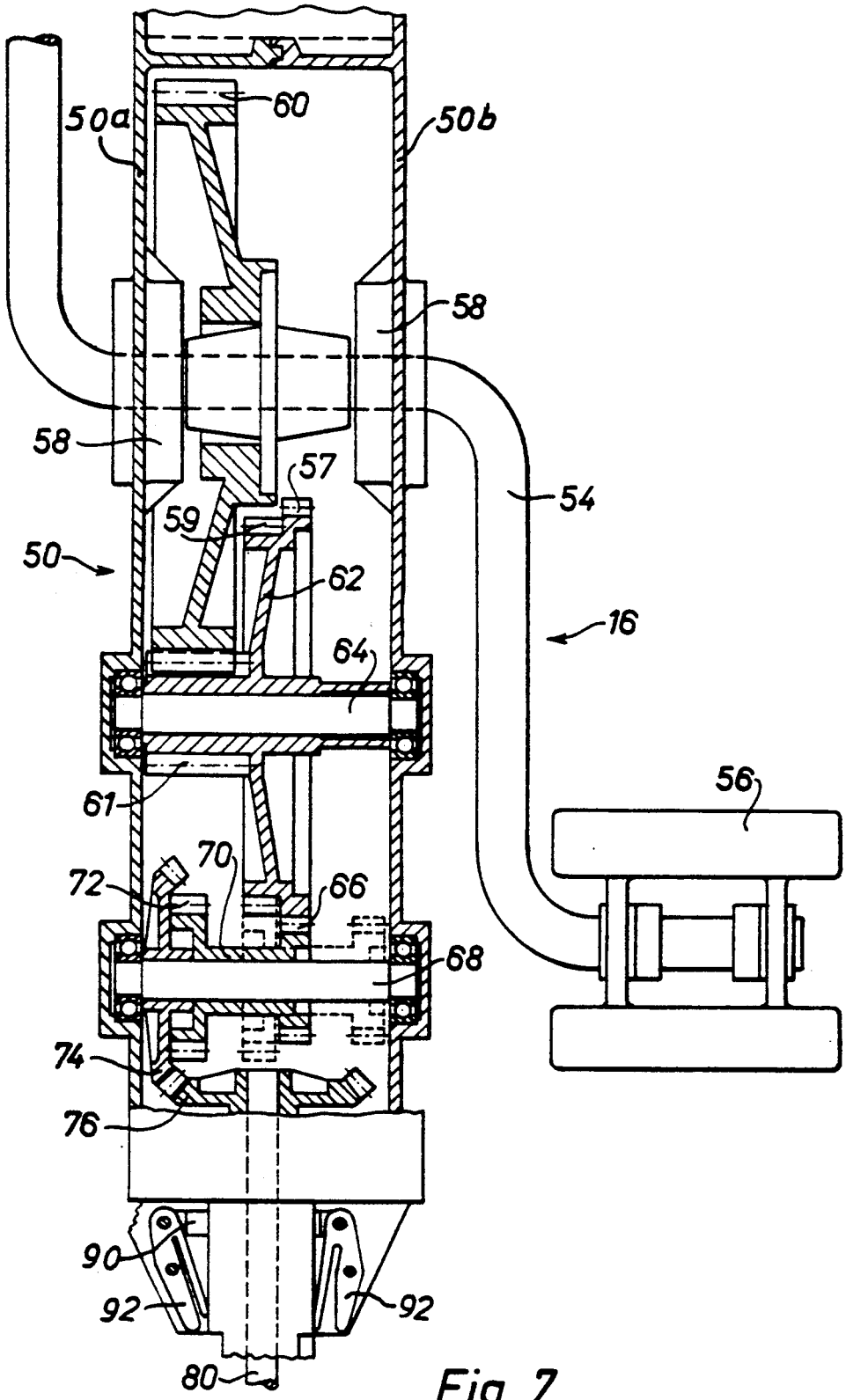
FIG. 7 is a vertical sectional view illustrating another embodiment of the pedal crank drive and gearing.
Figure 8:
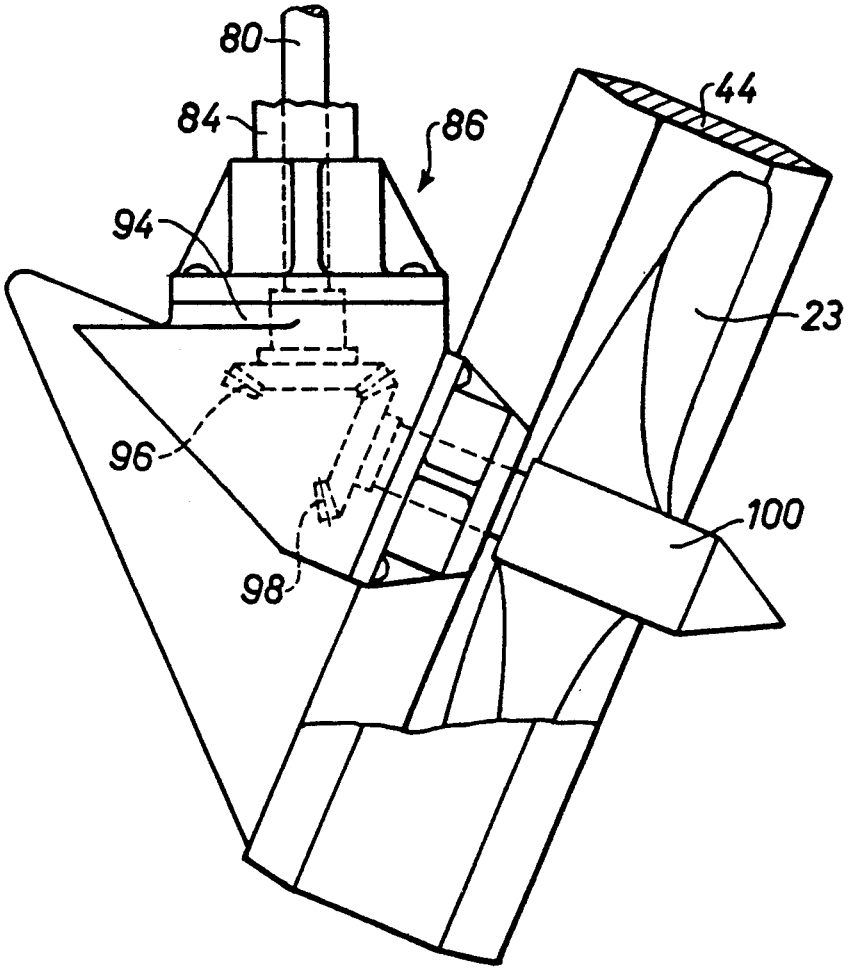
FIG. 8 is a part sectional view through a propeller drive and illustrating the gearing and drive therefore.
Figure 9:
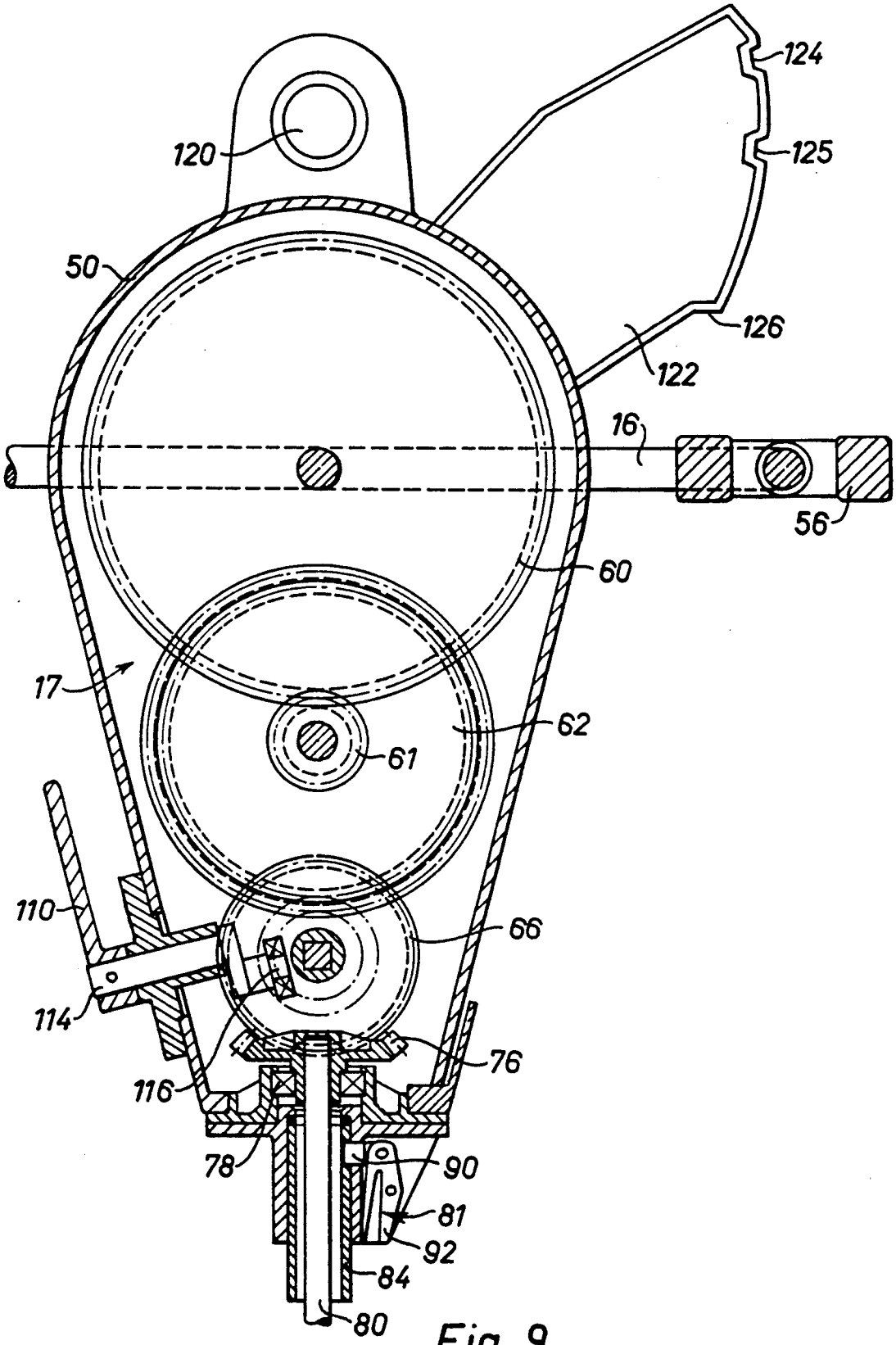
FIG. 9 is a sectional view through a gear housing, illustrating the gearing to drive the propeller shaft.

Many variations and different drive arrangements are possible. Referring now to FIG. 7–9, which illustrate a 2-speed drive arrangement for the propeller 32: a 2-part housing 50, having two shells 50*a* and 50*b*, retains the crank arm 16, as well known and in a suitable manner.

Pedals 56 are located at the outer, horizontal portion of the crank arms 54. The crank 16 is journalled in the housing 50 by ball bearings 58. The crank 16 is securely coupled to a large gear 60 which is an engagement with a small spur gear 61. The shaft of spur gear 61 is coupled to a second gear 62, rotatably fixed on a shaft 64, and located in suitable bearings in the housing 50. The gear 62 has two outer circumferential gears 57, 59, with different diameters. The larger diameter gear 57 is coupled to a gear 66 which is axially shiftable on the shaft 68. An axially shiftable sleeve is coupled to the gear 66, and carries a larger gear 72, thus permitting, by selective engagement of gear 66 with gear 57 or gear 72 with gear 59, two different transmission ratios. The shaft 68 further retains a spur gear 74 which is coupled with a spur gear 76, secured in a bearing 78. The sleeve 70 is rotatable with the shaft 68, for example by a spline connection.

The propeller 23 is coupled to the shaft 80 by a coupling unit 86 (FIG. 8). To permit the coupling unit 86, together with the propeller 23 to be separated from the housing 50, a coupling arrangement 81 (FIG. 9) is provided. A bushing or tube 84 surrounds propeller shaft 80. The coupling arrangement 81 includes at least one bolt 90, which can be engaged by a spring loaded operating handle 92 in a bore formed in sleeve or tube, or bushing 84, —or disengaged therefrom. FIG. 9 show bolt 90 engaged; FIG. 7 at the left side, shows bolt 90—released.

The lower end of the shaft 80 engages in a bearing of the unit 86 (FIG. 8) and carries a bevel gear 96, coupled with a further bevel gear 98, thus, drives the propeller stub shaft 100, which is suitably rotatably supported in the propeller housing 44.

Changing gears, or shifting is done by a hand lever 110. Referring to FIG. 9: A hand lever 110 is located on a shaft 114, and pivotable to and for. The inner end of the shaft 114 is coupled to an eccentric 116 which, in turn, causes axial shifting of the sleeve 70 and hence of the gears 66, 72, so that either the gear 66 or the gear 72 is an engagement with the respective gears 57 or 59 which, in turn, is coupled to the gear 72.

In accordance with a feature of the invention, the housing 50 can be rotated about a horizontal axis, by pivoting about tube element 120, (FIGS. 9, 10) which extends transversely to the intended direction of movement schematically shown by arrow A (FIG. 1) e.g. parallel to frame element 8 and upwardly thereof. Engagement positions marks or stops are provided for the positions of the housing 50 and hence of the propeller 23. The first engagement position is defined by an engagement notch 124; this position places the propeller 23 in reasonably deep water; a second engagement position is provided by an engagement notch 125 for shallow water; and a third engagement position is provided by an engagement abutment 126 to completely raise the propeller above the water line W.

Figure 11:
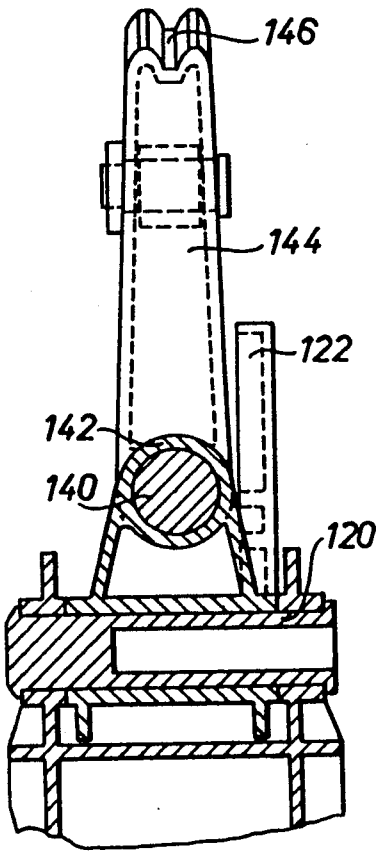
FIG. 11 is a sectional view along the broken section line XI—XI.
Figure 10:
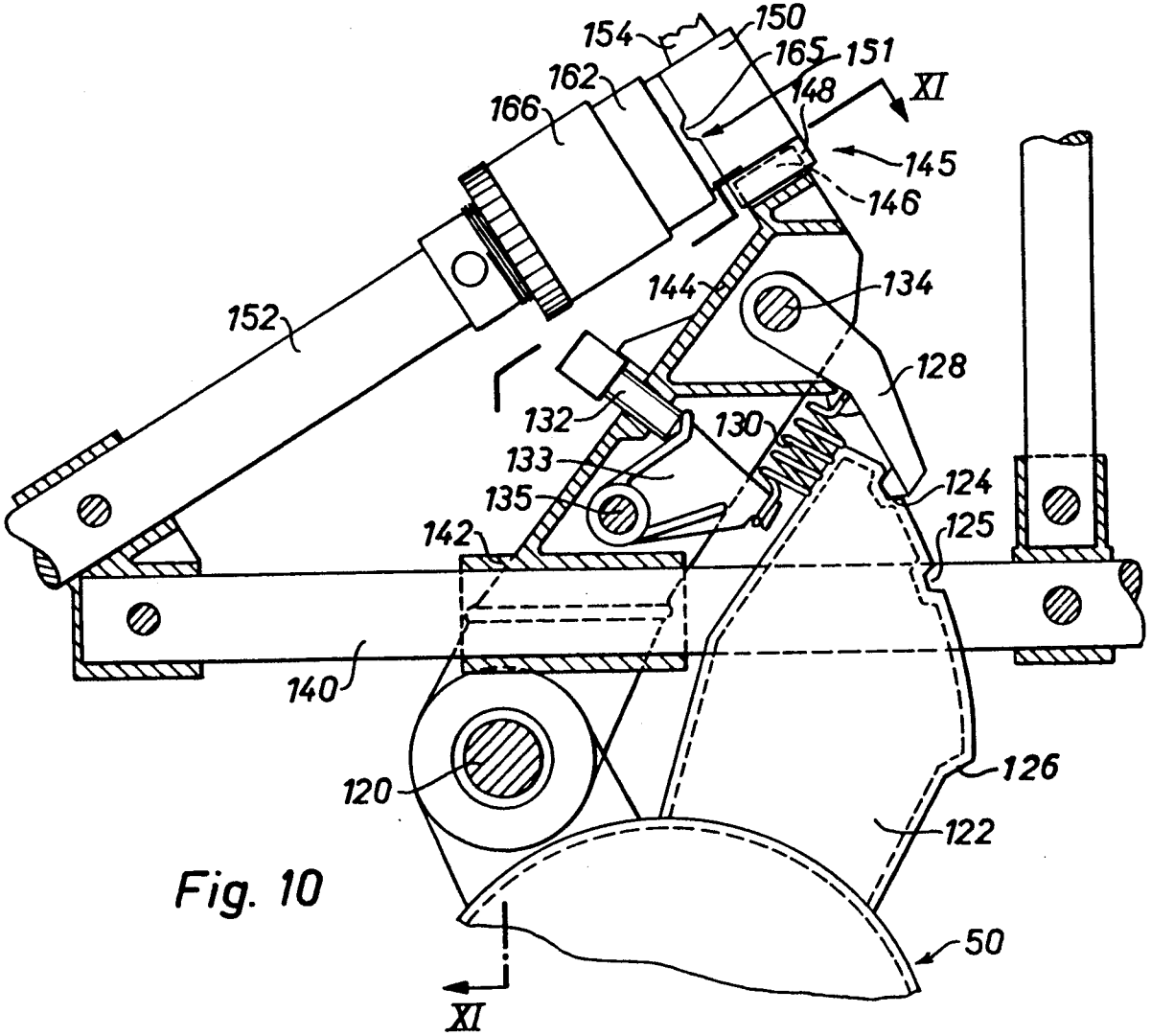
FIG. 10 is the cross-sectional view illustrating the overload release device permitting lateral pivoting of the drive elements.

In accordance with yet another feature of the invention and to prevent damage to the flotation bodies, and also to the water cycle as a whole, overload release devices are provided which, if the cycle meets an obstruction, provides for disengagement of elements subject damage. The overload safety element with respect to the propeller is best seen in FIGS. 10 and 11 which provides for raising the propeller 23 and the housing 50 therewith.

The positioning notches and abutments 124, 125 and 126 are formed in an extension 122, projecting from the housing 50. An engagement, or latch lever 128, loaded by a tension spring 130 is provided, for engagement in the respective notches 124, 125 or in the raised abutment 126. The latch lever 128, at the end remote from its engagement latch tip is rotatable about the shaft 134. The spring 130 is coupled on one end to the latch lever 128, and on the other to a lever 133 which is pivotable about a stub shaft 135. The position, and tension of the spring 130 can be adjusted by an adjustment screw 132, which engages the lever 133, to change the bias or tension of the spring 130, and permits user-selectable adjustment of the force necessary in order to lift the latch lever 128 from the latching notches 124, 125, 126, respectively. This permits matching the release force to the weight of the person using the cycle.

Figure 13:
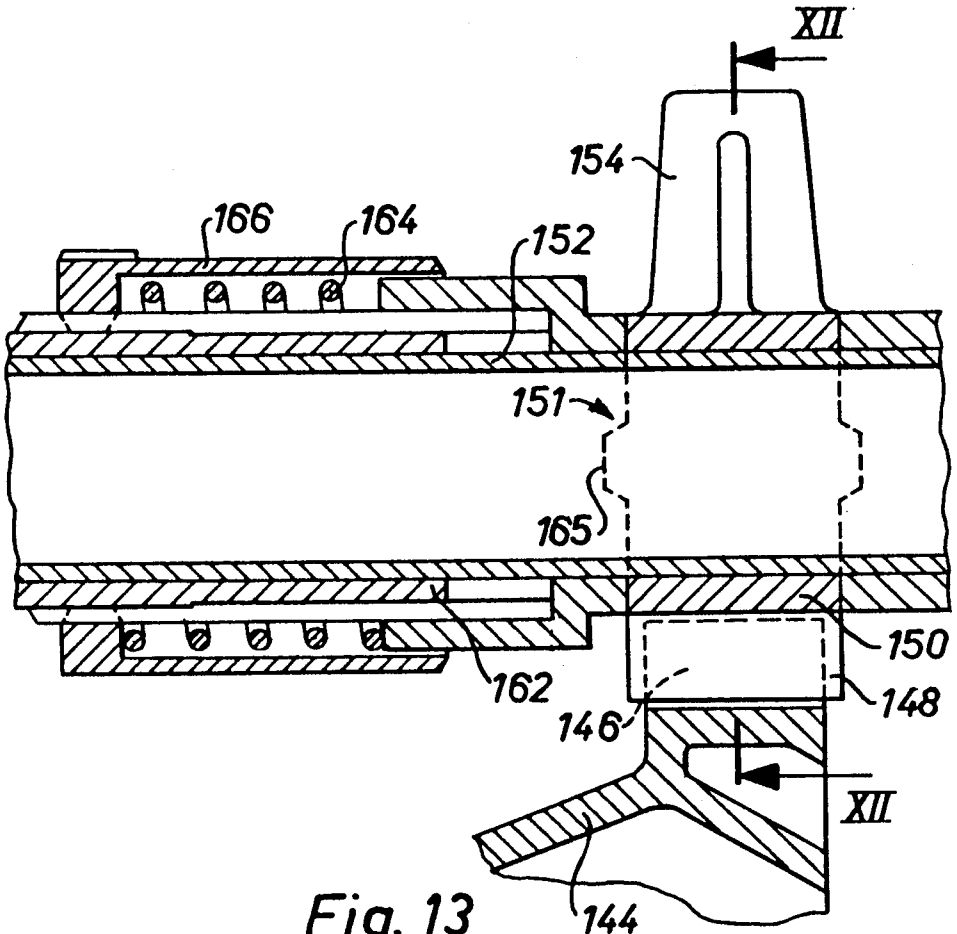
FIG. 13 is a fragmentary sectional representation of the overload arrangement of FIG. 12.
Figure 12:
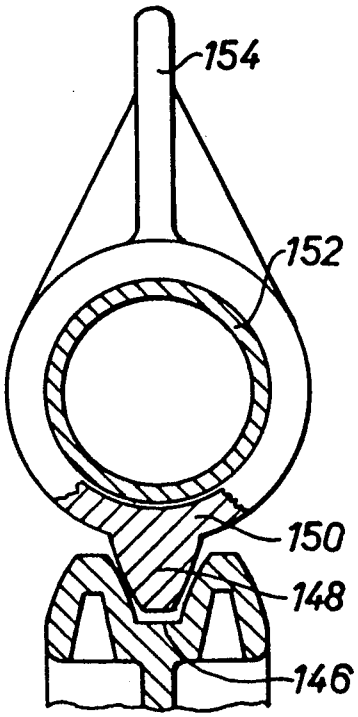
FIG. 12 illustrates an overload release mechanism, and is a section along line XII—XII of FIG. 13.

The cycle has a further overload release system 145, which permits lateral deflection of the housing 50 and the propeller 23 if an obstruction is encountered. A horizontal shaft 140, secured in the frame, and extending longitudinally, has a stub sleeve 142 rotatably located thereon. The shaft 140 extends in the direction of movement of the vehicle, see arrow A. The housing 50 including the propeller 23 can be rotated about the horizontal shaft 140, e.g. by securing shaft 120 thereto. An arm 144 is rigidly coupled to the sleeve 142, terminating in a groove 146. As best seen in FIGS. 12 and 13, a projection nose 148 of a coupling element 150 of a claw clutch 151 is engageable in the groove 146. The coupling nose 148 is rotatable about an inclined shaft 152, which has an operating wing 154 connected thereto to permit manual resetting. The facing end of the coupling element 150 is formed with projections which engage in matching recesses 165 of a coupling sleeve 162. The sleeve 162 is biased by a spring 164. The spring tension of the spring 164 can be adjusted by the threaded sleeve 166, fitting over the spring 164 and threaded or otherwise is adjustably secured to an intermediate sleeve element secured to the tube 152. This arrangement permits adjustment of the force by which the notch-depression inter-engaging arrangement 165 can be released and permit rotation of the coupling element 150. Thus, a force acting laterally on the housing 150 or on the propeller housing 44 which is in excess of a predetermined value causes deflection of the engagement nose 148 from the groove 146 so that the entire housing 50 and the drive arrangement therefore including the propeller 23 can pivot, thereby avoiding damage to the drive system.

To provide for lightweight yet sturdy structure, at least part of the gearing described can be made of high strength plastic material, which, furthermore, is noncorrosive and accepts water as a lubricating fluid.

Various change and modifications may be made within the scope of the invention.

I claim:

1. Recreational, readily assemblable and disassemblable water cycle having at least three flotation bodies (2*a*, 2*b*, 2*c*);

a plurality of frame elements;

a plurality of severable coupling means for severably coupling said elements together, and thus forming a frame (3);

said frame (3) being secured to the flotation bodies and extending upwardly therefrom, at least one of said flotation bodies being deflectable transversely with respect to said frame to provide for steering of the cycle;

a seat (5) secured to an upper portion of the frame; and wherein, in accordance with the invention, the flotation bodies (2a, 2b, 2c) are elongated;

the frame (3) comprises a plurality of essentially triangular frame portions (6, 7, 8; 6, 12, 13; 7, 12, 14; 8, 13, 14), said coupling means coupling said frame elements together to form said essentially triangular frame portions;

said frame portions forming a first triangular frame portion (6, 7, 8) which is in an essentially horizontal plane, when the cycle is in use, and further essentially triangular frame portion (6, 12, 13; 7, 12, 14; 8, 13, 14) located in planes inclined with respect to the horizontal plane, said further essentially triangular frame portions converging at a junction (15) to which said seat (5) is secured;

and further severable coupling means are provided, severably coupling the flotation bodies (2a, 2b, 2c) to the frame (3).

2. The cycle of claim 1, wherein said frame is tubular and the frame elements are tubular elements, optionally of light-weight metal.

3. The cycle of claim 1, wherein at least some of the coupling means (9, 10, 11) for coupling together the frame elements forming the first essentially triangular frame portion (6, 7, 8) as well as the frame elements forming the first and further frame portions include three-tube couplings.

4. The cycle of claim 3, wherein at least two of the three-tube coupling are of the tripod type, and include two coupling portions defining a first plane and a third coupling portion extending at an inclination from said first plane.

5. The cycle of claim 1, further comprising a crank drive (16);

a multi-speed, optionally a two-speed transmission (17) coupled with the crank drive;

at transmission housing (50) retaining the transmission, said transmission housing comprising two separable housing shells (50a, 50b); and a propeller shaft (80) and a propeller (23) coupled with the propeller shaft, said propeller shaft extending into the housing and being coupled to the multi-speed transmission.

6. The cycle of claim 1, wherein said coupling means (9, 10, 11) comprise sleeve or bushing elements with which said frame elements are connectable by telescoping push-on connections;

one of said elements being formed with two transversely, diametrically aligned openings (33) and the other of said elements including two spring-loaded bolts (30) diametrically located in said other of said elements nd engageable with said diametrically aligned openings (33) for selectively locking the push-on connection while permitting depression of the bolts (30, 30') against the spring loading for releasing the connection.

7. The cycle of claim 6, wherein spring means (41) are provided for spring-loading the bolts (30, 30'), said spring means being located inside of the other of said elements.

8. The cycle of claim 1, wherein the flotation bodies (2a, 2b, 2c) are inflatable and collapsible bodies which, when inflated, have generally torpedo-like shape, including akeel (40).

9. The cycle of claim 8, wherein at least one (2a), of said flotation bodies (2a, 2b, 2c) is movable about an essentially horizontal axis of freedom to permit limited pivoting movement of the forward flotation body (2a), so that it can ride over or pivot about small waves.

10. The cycle of claim 1, further including a crank drive (16);

a paddle wheel (35) located between two (2b, 2c) of said flotation bodies and having paddles (39) releasably secured to a hub (35') of the paddle wheel; and a chain drive connection (37) between the paddle wheel and the crank drive (16).

11. The cycle of claim 1, further including a crank drive (16);

a transmission gear (17; 60, 62, 66,72) coupled to the crank drive;

a transmission gear housing (26, 50) retaining said transmission gear;

a propeller (23);

a propeller shaft (24, 80) connected to the propeller (23); and releasable coupling means (84, 90, 92) severably connecting the propeller shaft (24, 80) to said transmission gear housing (26, 50) for severably coupling together the transmission ear to the propeller and permit disassembly of the propeller shaft and the propeller from the transmission ear for transport and storage.

12. The cycle of claim 11, wherein said releasable coupling means comprises a propeller shaft bushing or sleeve (84); and interengaging locking means (90, 92) locking said propeller shaft or sleeve (84) to the transmission ear housing.

13. The cycle of claim 1, wherein one (2a) of said flotation bodies is steerable about an axis essentially perpendicular to said plane;

a steering rod post (25) coupled to said one flotation body (2a);

at least one essentially triangular bracing frame portion (25, 276, 6; 25, 277, 7)p and wherein said severable coupling mean include coupling elements (279, 272, 273, 9, 38) coupling said bracing triangular frame portions to the steering post and said first frame portion, respectively.

14. Recreational, readily assemblable and disassemblable water cycle having at least three flotation bodies (2a, 2b, 2c);

a frame (23) secured to the flotation bodies and extending upwardly therefrom, at least one of said flotation bodies being deflectable transversely with respect to said frame to provide for steering of the cycle;

a seat (5) secured to an upper portion of the frame;

severable coupling means (9, 38, 10, 11; 9a, 10a, 11a) severably coupling the flotation bodies to the frame, said frame comprising a plurality of releasable frame elements (6, 7, 8; 12, 13, 14, 24, 25) and frame coupling means (9, 10, 11, 30, 30', 33, 41) for releasably coupling the frame elements together;

a crank drive (16);

a transmission (17) coupled with the crank drive;

a transmission housing (50) retaining the transmission;

a propeller shaft (80) and a propeller (23) coupled with the propeller shaft;

means for retaining the housing, including the propeller shaft and the propeller on said frame, and permitting pivotable movement of the housing (50) including the propeller and propeller shaft about an essentially horizontal axis (120) which extends generally transversely to the intended direction of movement (A) of the cycle;

a positioning element (122) formed with positioning marks (124, 125, 126) coupled to the housing;

a spring-loaded engagement lever (128) engageable with selected ones of said positioning marks; and adjustment means to control the positioning force of the engagement leer (128), wherein the essentially horizontal pivoting axis (120) of the housing (50) is vertically spaced from the axis of rotation of the crank drive.

15. The water cycle of claim 14, further including means for permitting rotation of the housing (50) abort an axis (140) transversely to the essentially horizontal pivoting axis (120) of the housing, said means including spring-loaded mans to permit deflection of the housing laterally of the water cycle if an obstruction is encountered.

16. The cycle of claim 14, wherein said frame is tubular and the frame include tubular frame elements, optionally of light-weight metal.

17. The cycle of claim 14, further including releasable coupling means (84, 90, 92) severably connecting the propeller shaft (24, 80) to said transmission gear housing (26, 50) for severably coupling together the transmission ear to the propeller and permit disassembly of the propeller shaft and the propeller from the transmission gear for transport and storage.

18. Recreational, readily assemblable and disassemblable water cycle having at least three flotation bodies (2*a*, 2*b*, 2*c*);

a frame (3) secured to the flotation bodies and extending upwardly therefrom, at least one of said flotation bodies being deflectable transversely with respect to said frame to provide for steering of the cycle;

a seat (5) secured to an upper portion of the frame;

severable coupling means (9, 38, 10, 11; 9*a*, 10*a*, 11*a*) severably coupling the flotation bodies to the frame, said frame comprising a plurality of releasable frame elements (6, 7, 8; 12, 13, 14, 24, 25) and frame coupling means (9, 10, 11, 30, 30', 33, 41) for releasably coupling the frame elements together;

a crank drive (16);

a transmission (17) coupled with the crank drive;

a transmission housing (50) retaining the transmission;

a propeller shaft (80) and a propeller (23) coupled with the propeller shaft;

means for retaining the housing, including the propeller shaft and the propeller on said frame, and permitting pivotable movement of the housing (50) including the propeller and propeller shaft about an essentially horizontal axis (120) which extends generally transversely to the intended direction of movement (A) of the cycle;

means for permitting rotation of the housing (50) about an axis (140) transversely to the essentially horizontal pivoting axis (120) of the housing, including spring-loaded means to permit deflection of the housing laterally of the cycle if an obstruction is encountered, said lateral deflection means comprising an arm (1440 rigidly coupled to the housing (50) and having a spring-loaded positioning arrangement at an end thereof remote from the housing, said positioning arrangement (145) including a rotatable coupling (146, 148) nd a spring-loaded claw or jaw clutch (151), operatively associated with the rotatable coupling, including a setting spring (164) and adjustment means (166) to adjust tension of the setting spring, the rotatable coupling element controlling the engagement and disengagement force of the rotatable coupling.

19. The cycle of claim 18, wherein said frame is tubular and the frame include tubular frame elements, optionally of light-weight metal.

20. The cycle of claim 18, further including releasable coupling means (84, 90, 92) severably connecting the propeller shaft (24, 80) to said transmission ear housing (26, 50) for severably coupling together the transmission gear to the propeller and permit disassembly of the propeller shaft and the propeller from the transmission gear for transport and storage.

* * * * *